United States Patent [19]

Hunt

[11] Patent Number: 4,826,041

[45] Date of Patent: May 2, 1989

[54] TOOTHPICK DISPENSER WITH NON-JAM DISPENSING GROOVES AND BOX TRAVEL LIMIT STOP

[76] Inventor: Ben A. Hunt, 5835 Vanderbilt, Dallas, Tex. 75206

[21] Appl. No.: 897,411

[22] Filed: Aug. 18, 1986

[51] Int. Cl.[4] ..... B65H 3/00

[52] U.S. Cl. ..... 221/152; 221/186; 221/191; 221/287; 312/73

[58] Field of Search ..... 221/151, 152, 154, 186, 221/187, 191, 194, 195, 196, 209, 256, 287, 188, 189, 257; 222/160, 162, 153; 312/45, 73; D 7/75; D 28/64

[56] References Cited

U.S. PATENT DOCUMENTS

| | | | |
|---|---|---|---|
| D. 197,027 | 12/1963 | Hunt | D 7/75 |
| D. 197,579 | 2/1964 | Vernon | 221/186 X |
| D. 201,517 | 6/1965 | Hunt | D 7/75 |
| D. 201,518 | 6/1965 | Hunt | D 7/75 |
| 593,353 | 11/1897 | Flanders et al. | 221/257 |
| 730,232 | 6/1903 | Caille | 221/256 X |
| 823,036 | 6/1906 | Crites et al. | 221/257 X |
| 1,444,031 | 2/1923 | Malocsay | 221/186 |
| 1,678,281 | 7/1928 | Cole | 221/186 |
| 1,678,355 | 7/1928 | Roberts | 221/257 X |
| 1,880,163 | 9/1932 | Villochi | D 7/75 X |
| 2,493,334 | 1/1950 | Block | 221/187 |
| 3,549,047 | 12/1970 | Radtke | 221/186 X |

FOREIGN PATENT DOCUMENTS

| | | | |
|---|---|---|---|
| 23004 | of 1906 | United Kingdom | 221/186 |

*Primary Examiner*—Joseph J. Rolla
*Assistant Examiner*—Edward S. Ammeen
*Attorney, Agent, or Firm*—Warren H. Kintzinger

[57] ABSTRACT

A toothpick dispenser with an elevated base having opposite end mount pedestals that rest on a supporting surface with the elevated base mounting a toothpick box that is slideable back and forth between opposite end limited positions. One position is established by limit position contact of the box with one of the pedestals and a lock device mounted in the elevated base at the mount pedestal at the other end is movable into an end limit blocking position for the box when the elevated base is put down on a supporting surface. There are two toothpick dispensing grooves in the upper surface of the elevated base, one for each of the opposite end positions of the toothpick holding box with the back edge of each groove being rounded to prevent jamming up of the dispenser box by either square centered toothpicks or round centered toothpicks whichever is being dispensed.

12 Claims, 2 Drawing Sheets

TOOTHPICK DISPENSER WITH NON-JAM DISPENSING GROOVES AND BOX TRAVEL LIMIT STOP

Figure 1:
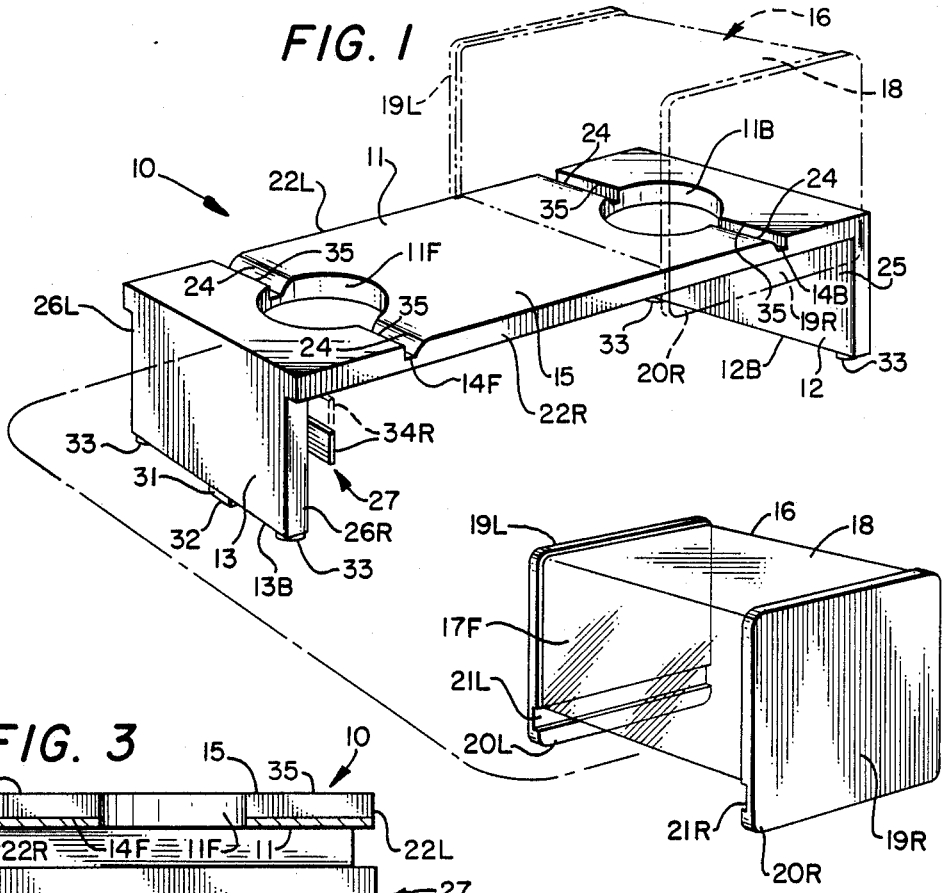

This invention relates in general to toothpick dispensers, and more particularly to a toothpick dispenser with non-jam sloped back rounded back edged dispensing grooves and end position stop on an elevated base for a toothpick box slideable back and forth on the base for dispensing toothpicks to the opposite end dispensing grooves.

Toothpick dispensers (or dispensers for elongate slender articles) have been provided that have a dispensing box that slides back and forth on a base feeding the article being dispensed to opposite end dispensing grooves formed in the upper face of the base. Jamming of the dispenser occurs, with either square centered toothpicks or with round centered toothpicks, with square cornered grooves. As the toothpick container is moved back and forth and a square centered or a round centered toothpick has fallen into a dispensing groove the motion of other toothpicks with the container across the groove creates static electricity that tends to pull the single toothpick out of the groove or partially lift it up to jam the dispenser box from continued movement. With rounded center toothpicks there is also a problem of these toothpicks moving at an angle into the groove causing dispenser jam up with only one end of a pick having fallen into a dispensing groove. Providing each dispensing groove with a non-jam sloped back and rounded back edge minimizes such jamming hazards.

A toothpick dispenser having an elevated base mounting a toothpick box that is slideable back and forth between opposite end toothpick dispensing positions feeding toothpicks to two opposite end dispensing grooves is faced with the problem of toothpick spillage if the dispenser is not provided with positive opposite end box movement limit stops. Various toothpick dispensers have been provided that have an open bottomed toothpick storing box having opposite end walls that have downward extensions grooved to encompass and slide along side edges of an elevated dispenser base. The box is limited sliding travel along the base by end position contact with a base support pedestal at one end. The other end support pedestal, however, is not as wide and the box may be slid further than required for dispensing a toothpick to the dispensing groove at that end and even completely off the base for refilling the box with a supply of toothpicks. Without a box travel positive stop at one of the base ends, the box may be slid too far with toothpick spillage occurring. Some dispensers have been provided with mechanical box end position stops, but these have been complex and generally require too much an effort to dismount for box removal, toothpick refilling and replacement. Thus, it appears that there is a need for a toothpick dispenser end position limit stop that moves into box movement limit stop position when the dispenser is placed on a supporting surface and that remains in the stop position while the dispenser is at rest on a supporting surface.

It is therefore a principal object of this invention to provide a toothpick dispenser that avoids toothpick box and dispensing groove jamming.

Another object is to provide such a toothpick dispenser that minimizes toothpick lift up out of a dispensing groove, A further object is to minimize toothpick spillage from the toothpick supply box of a dispenser.

Still another object is to minimize handling contamination of toothpicks being dispensed.

Features of the invention useful in accomplishing the above objects include, in a toothpick dispenser with non-jam dispensing grooves and box travel limit position stop, an elevated base mounting a toothpick box that is slideable back and forth between opposite end toothpick dispensing positions feeding toothpicks to two opposite end dispensing grooves. The toothpick box is an open bottomed toothpick storing box having opposite end walls with downward extensions grooved to encompass and slide along side edges of the elevated dispenser base with the box being slid along back and forth over the base between dispensing positions. The box is limited in sliding travel along the base in one direction by end position contact with a base support pedestal at the one end. The base support pedestal at the other end, however, is not as wide so the box may be slid completely off the base for refilling with toothpicks. In order to prevent the box from being moved too far in the removal direction from the base when loaded with toothpicks and with the dispenser on a supporting surface a box end position limit stop is provided that moves into box movement limit stop position when the dispenser is placed on a supporting surface and that remains in the stop position while the dispenser is at rest on the supporting surface. The two opposite end toothpick dispensing grooves are provided in the upper surface of the elevated base with the inward back edge of each groove being a sloped back and rounded back edge to minimize groove dispensed toothpick static electricity pick up and/or box to groove toothpick jamming.

Specific embodiments representing what are presently regarded as the best modes of carrying out the invention are illustrated in the accompanying drawings.

Figure 3:
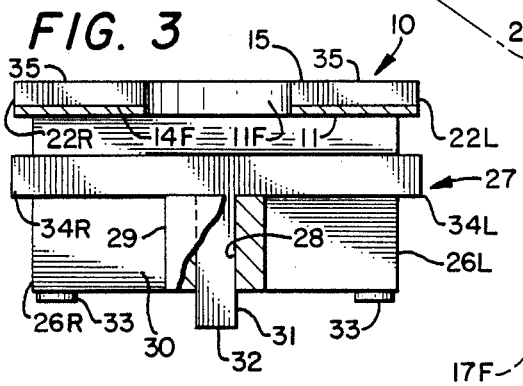
Figure 2:
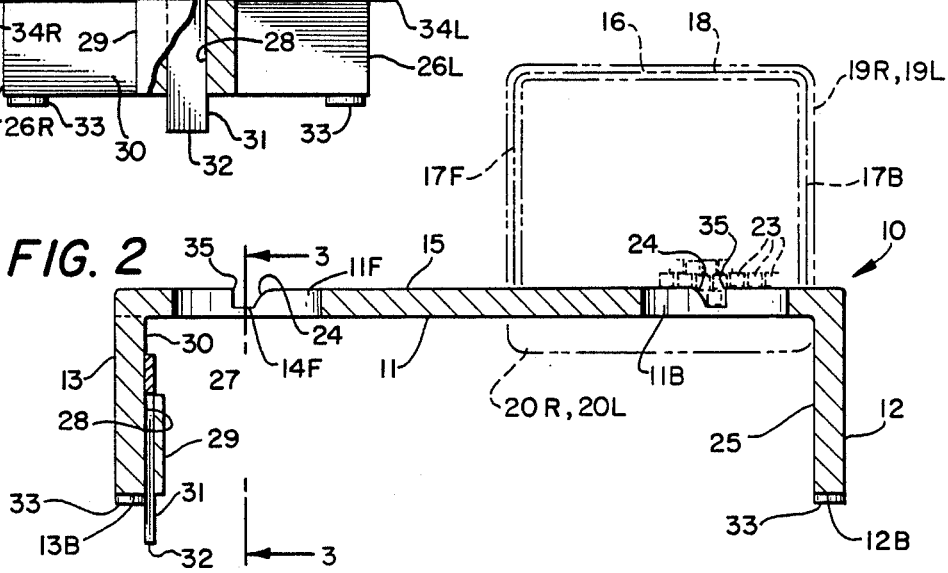
Figure 4:
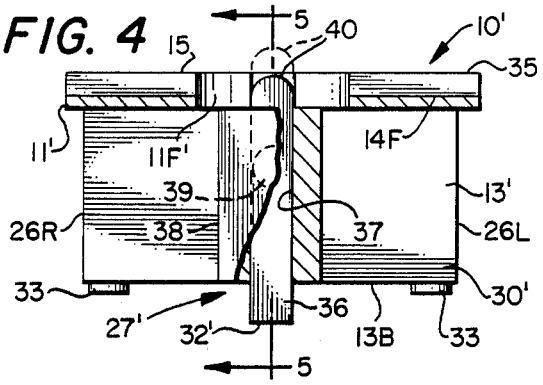
Figure 5:
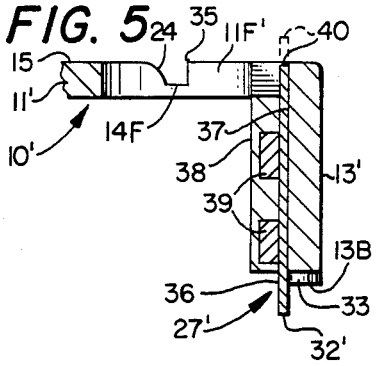
Figure 6:
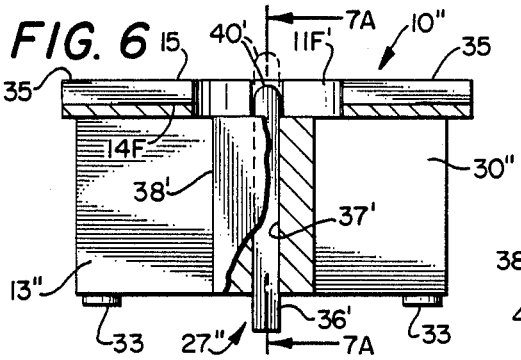

In the drawings:

FIG. 1 represents a perspective view of a dispenser base and the toothpick box therefore in phantom on the base and removed from the base;

FIG. 2 a cut away and sectioned view taken along line 2—2 of FIG. 1 showing dispenser base detail;

FIG. 3 a partially cut away and sectioned view taken generally from line 3—3 of FIG. 2, showing additional dispenser base detail and dispenser box end position stop mechanism detail;

FIG. 4 a partially cut away and sectioned view like FIG. 3 showing detail of another dispenser base box end position stop mechanism embodiment;

FIG. 5 a partial cut away and sectioned view taken along line 5—5 of FIG. 4 showing additional detail of the base and box end position stop mechanism of the FIG. 4 embodiment;

FIG. 6 a partially cut away and sectioned view like FIGS. 3 and 4 showing detail of still another dispenser base box end position stop mechanism embodiment.

Figure 7A:
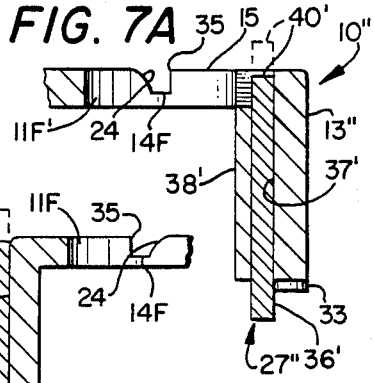
Figure 7B:
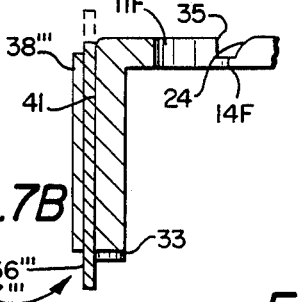
Figure 9:
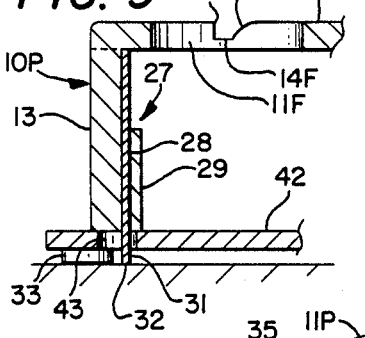
Figure 8:
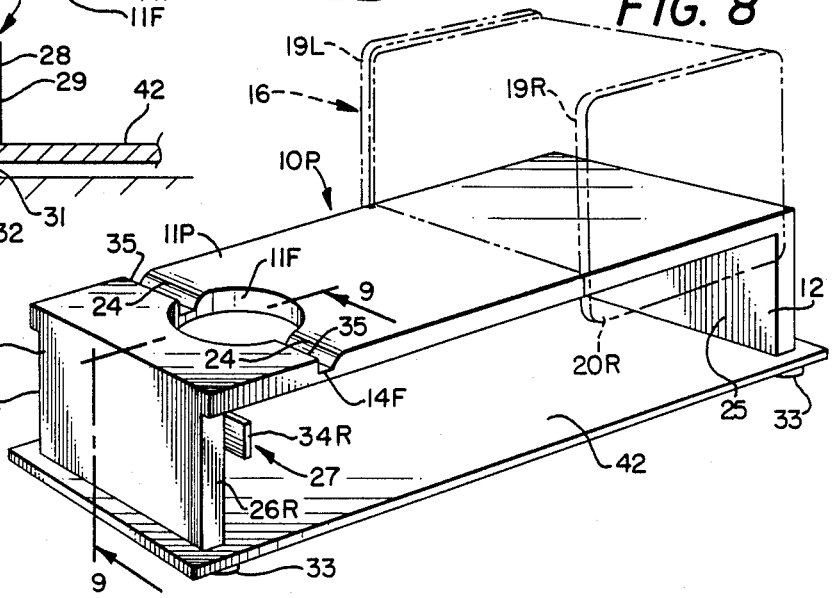

FIGS. 7A and 7B, partially cut away and sectioned views, 7A taken along line 7A—7A of FIG. 6 showing additional detail of the base and box end position stop mechanism of the FIG. 6 embodiment, and 7B an alternate with the stop mechanism outside rather than inside the front pedestal;

FIG. 8 a perspective view like FIG. 1 of another toothpick dispenser embodiment with one dispensing groove and with a bottom platform; and FIG. 9 a partially cut away and sectioned view taken along line 9—9 of FIG. 8 showing additional detail of the base, the base platform and the box end position stop mechanism.

REFERRING TO THE DRAWINGS:

The toothpick dispenser 10 of FIGS. 1, 2 and 3 is shown to have an elevated base 11 supported by a rear pedestal 12 at a rear end and front pedestal 13 at the front end. Two opposite toothpick dispensing grooves, a front groove 14F and a rear groove 14B, are provided in the upper surface 15 of the elevated base 11 and other than openings 11F and 11B through the base extend transversely across the base 11 from side to side thereof. The toothpick supply box 16 is an open bottomed box having transparent front and back walls 17F and 17B, top wall 18, and left and right end walls 19L and 19R, respectively, that may be transparent or opaque. The box left and right end walls 19L and 19R are opposite end walls with downwardly extending extensions 20L and 20R having inwardly facing grooves 21L and 21R to encompass the opposite side edges 22L and 22R of the elevated base 11. The grooves 21L and 21R are sized to permit free sliding movement of the box 16 on the elevated base 11 and to guide such movement back and forth on the base 11. With the box 16 an open bottomed box toothpicks 23 held therein are supported by the upper surface 15 and slid there across with back and forth sliding movement of the box 16 on the elevated base 11. A toothpick moves from the supply in box 16 to a groove 14F or 14B whenever the box 16 is slid into a dispensing position over a groove 14 that is not already occupied by a toothpick 23. As the toothpick containing box 16 is slid back and forth and a square centered or round centered toothpick has fallen into a dispensing groove 14 the sliding motion of other toothpicks with the container box 16 over base upper surface 15 across the groove 14 creates static electricity that tends to pull a single toothpick out of a groove 14, hold it from groove entry, or partially lift it up to jam the dispenser box 16 from continued movement. Further, toothpicks particularly rounded center toothpicks sometimes move at an angle into a dispensing groove causing dispenser jam up with only one end of a pick having fallen into a dispensing groove. Each of the grooves 14F and 14B is provided with a sloped and rounded inner facing back edge 24 that aids in countering the static electricity attraction problem and that helps overcome non-alignment of toothpicks entry to a groove 14. The sloped and rounded inner facing back edge 24 of each groove 14 is on the side of the groove that the toothpick supply box 16 passes over first as the box is being moved toward the toothpick dispensing position at that end of the dispenser 10. The toothpick supply box 16 is slideable back and forth between opposite end limit positions with one position determined by limit position contact of box downward extended extensions 20L and 20R with the inside face 25 of rear pedestal 12 that is the same in width as the elevated base 11. The front pedestal 13 is of less width than the elevated base 11 and rear pedestal 12 with the side edges 26L and 26R set in sufficiently from, respectively, the side edges 22L and 22R of the elevated base 11 for the box 16 extensions 20L and 20R to clear and permit sliding removal of the box from the base 11 for refilling with toothpicks (or other elongate items the dispenser may be used for). To prevent toothpick spillage with movement of the box 16 too far at the front pedestal 13 end of the dispenser 10 a mechanical box end position stop device 27 is mounted on the base 11 at the front pedestal 13 end that is moved into the box end position stop state as the box 16 is placed on a supporting surface. In the embodiment of FIGS. 1, 2 and 3 the stop device 27 is in the form of a "T" with the bottom of the "T" slidingly mounted in an elongate channel opening 28 through a boss 29 from the interior wall 30 of the front pedestal 13 and with the bottom stem 31 of the "T" long enough that in its lowered state the bottom end 32 of stem 31 extends below the support plane of the bottom of the support pads 33 provided on the bottoms 12B and 13B of the pedestals 12 and 13. The top of the "T" opposite side arms 34L and 34R extend outwardly to opposite sides far enough to be a box 16 end position limit stop when the "T" device 27 is in its raised stop position, indicated in phantom in FIG. 1, that it is moved into and maintained as the dispenser 10 is placed on and as it rests on a supporting surface with bottom end 32 pushed up by the support surface. Then when the dispenser 10 is lifted away from the supporting surface the box 16 end position limit stop "T" device 27 drops to, or is pushed down to, it's lowered position shown in FIGS. 1, 2, and 3 with the bottoms of the "T" opposite side arms 34L and 34R in contact with the top of boss 29, the dispenser box 16 may be slid off the base 11 for refilling.

It should be noted that openings 11F and 11B provide clearance for the fingers in grasping toothpicks dispensed from box 18 to grooves 14F and 14B. Further, the sharp top corners 35 of grooves 14F and 14B, opposite rounded and sloped corners 24, coupled with the grooves 14 being deeper than the thickness of toothpicks deposited therein are such to catch toothpicks 23 enough to give beneficially an unbunching affect thereto as the box 16 with toothpicks therein are slid over the grooves 14F and 14B.

The dispenser 10' of FIGS. 4 and 5 is provided with a dispenser base 11' and box 16 end limit position stop device 27' embodiment differing from the embodiment of FIGS. 1,2, and 3. With this embodiment a strap magnetic metal section stop member 36 is slideably mounted in opening 37 extending vertically through a boss 38 mounted on the interior wall 30' of the front pedestal 13'. Magnet sections 39 imbedded in boss 38 hold the strap metal section stop member 36 in place from falling out when the dispenser is lifted from a supporting surface. The strap magnetic metal section 36 has a flat bottom 32' that contacts the support surface to push the section stop member 36 up into the box 16 end limit position stop state engaging box side 17F with the rounded top 40 thereof extended above the upper surface 15' of the elevated base 11'.

With reference to the dispenser 10'' of FIGS. 6 and 7A the front pedestal 13'' is provided with a boss 38' mounted on the interior wall 30'' of the pedestal 13''. Boss 38' has an opening 37' extended vertically there through which an elongate plunger stop member 36' is slideably mounted for movement up and down like the stop member 36 of FIGS. 4 and 5 in a box 16 stop device 27'' embodiment. The member 36' is a friction fit in the opening 37' to hold position against fall out when the dispenser 10'' is lifted from a supporting surface and yet permit movement thereof to the box 16 stop state or non stop state as permitted and as desired.

Referring also to the further embodiment of FIG. 7B the box 16 end limit position stop device 27''' has an elongate plunger stop member 36''' slideably mounted in an opening 37''' in a boss 38''' mounted on the outside wall 41 of the pedestal 13''' . The stop member 36''' is moveable between up stop and down positions just like stop member 36″ of the FIGS. 6 and 7A embodiment.

The dispenser 10F embodiment of FIGS. 8 and 9 is very much like the embodiment of FIGS. 1, 2, and 3 with, however, a base platform 42 mounted to the bottoms of front and rear pedestals 13 and 12 and the support pads 33 fastened to the bottom of base platform 42. This approach requires that there be an opening 43 in the base platform 42 that the bottom stem 31 of the "T⇄ can extend therethrough for contact of the stem bottom end 32 with a supporting surface the dispenser 10P is placed on. It should be realized that the elevated base 11P could be a two groove 14F and 14B equipped base just like base 11 of the FIGS. 1, 2, and 3 embodiment, or have more than two grooves 14. It is shown in this instance, however, to be equipped with only one groove 14F in a foreshortened more compact dispenser version. Other than the different features presented other features are the same with description applicable to the embodiment of FIGS. 1, 2, and 3 applicable again here and with the same identification numbers being applied to the same features.

Whereas this invention has been described with respect to several embodiments thereof, it should be realized that various changes may be made without departure from the essential contributions to the art made by the teachings hereof.

I claim:

1. A dispenser for elongate slender articles comprising: an elongate elevated base with spaced parallel side edges, an upper surface, a bottom, and opposite ends; a first support pedestal fastened to and extended downward from the bottom of said base; a second support pedestal fastened to and extended downward from the bottom of said base; elongate slender article storing box means having opposite side walls, opposite end walls, and a top, and with the walls presenting an open bottom; said box means opposite end walls having downward extensions grooved to encompass and slide along said side edges of said elongate elevated base with sliding movement of said box means back and forth over the upper surface of said elongate elevated base into and out of article dispensing position of said box means on said elongate elevated base; elongate slender article receiving and dispensing groove means in the upper surface of said elongate elevated base with a groove shape having a sloped and rounded article entrance edge and a rear wall with a sharp cornered top edge; opening means through said elongate elevated base in the path of said groove means to facilitate grasping a groove contained elongate article when said box means has been slid out of an article dispensing position on said elongate elevated base; and with said article dispensing groove means extended, other than for said opening means, transversely across said elongate elevated base from side edge to side edge thereof; wherein said elongate slender article receiving and dispensing groove means is a single groove with opposite end sections separated by said opening means; said opening means is a circular opening centrally located in the path of said groove in said elongate elevated base between the base side edges; end limit position box means travel stop means is provided with said dispenser for limiting back and forth sliding movement of said box means on said elongate elevated base; said end limit position box means travel stop means at a first end of said elongate elevated base is stop contact abutment of ends of said box means opposite end walls downward extensions with said first support pedestal; and with said first support pedestal sufficiently wide to present stop contact abutting surface in the path said box means opposite end downward extensions; said second support pedestal is of sufficiently less width than said first support pedestal to permit sliding passage thereby of said box means for removal of the box means from said elongate base for refilling of said box means with elongate slender articles to be dispensed and replacement of the box means back on said elongate base; said end limit position box means travel stop means at a second end of said elongate elevated base is a box end travel position stop structure mounted at said second end of said elongate elevated base; said box end travel position stop structure including a mounting boss with a channel opening extending therethrough, and a stop member slideably mounted in said channel opening having a portion thereof moveable into and out of stop contact abutment position in the path of sliding movement of said box means; said stop member extends downwardly sufficiently far to present a bottom end engageable by a supporting surface the dispenser is placed on and be pushed by the supporting surface as the dispenser is lowered to the supporting surface sufficiently to raise said stop member from the box means non stop position into the stop contact abutment position in the path of sliding movement of said box means.

2. The dispenser for elongate articles of claim 1, wherein said stop member is in the form of a "T" with the bottom stem of the "T" slideably mounted in said channel opening; and with opposite side arms of the "T" top extended outwardly to opposite sides sufficiently far to be moveable into and out of obstruction position to the path of movement of said box means opposite end wall downward extensions.

3. The dispenser for elongate slender articles of claim 1, wherein said stop member is in the form of a magnetic metal strap section slideably mounted in said channel opening; magnetic means imbedded in said mounting boss to hold said strap section in set position therein; and the stop member portion moveable into and out of stop contact abutment position in the path of sliding movement of said box means is a top end of said strap section moveable into position extending above the plane of the upper surface of said elevated base.

4. The dispenser for elongate slender articles of claim 1, wherein said stop member is in the form of an elongate plunger that is a position friction holding fit in said channel opening; and the stop member portion moveable into and out of stop contact abutment position in the path of sliding movement of said box means is a top end of said elongate plunger moveable into position extending above the plane of the upper surface of said elevated base.

5. A dispenser for elongate slender articles comprising: an elongate elevated base with spaced parallel side edges, an upper surface, a bottom, and opposite ends; a first support pedestal fastened to and extended downward from the bottom of said base; a second support pedestal fastened to and extended downward from the bottom of said base; elongate slender article storing box means having opposite side walls, opposite end walls, and a top, and with the walls presenting an open bottom; said box means opposite end walls having downward extensions grooved to encompass and slide along said side edges of said elongate elevated base with sliding movement of said box means back and forth over the upper surface of said elongate elevated base into and out of article dispensing position of said box means on said elongate elevated base; elongate slender article receiving and dispensing groove means in the upper surface of said elongate elevated base with a groove shape having a sloped and rounded article entrance edge and a rear wall with a sharp cornered top edge; opening means through said elongate elevated base in the path of said groove means to facilitate grasping a groove contained elongate article when said box means has been slid out of an article dispensing position on said elongate elevated base; with said article dispensing groove means extended, other than for said opening means, transversely across said elongate elevated base from side to side edge thereof; wherein end limit position box means travel stop means is provided with said dispenser for limiting back and forth sliding movement of said box means on said elongate base; said end limit position box means travel stop means at a first end of said elongate elevated base is stop contact abutment of ends of said box means opposite end walls downward extensions with said first support pedestal and with said first support pedestal sufficiently wide to present stop contact abutting surface in the path of said box means opposite end walls downward extensions; said second support pedestal is of sufficiently less width than said first support pedestal to permit sliding passage thereby of said box means for removal of the box means from said elongate base for refilling of said box means with elongate slender articles to be dispensed and replacement of the box means back on said elongate base; said end limit position box means travel stop means at a second end of said elongate elevated base is a box end travel position stop structure mounted at said second end of said elongate elevated base; said box end travel position stop structure including, a mounting boss with a channel opening extended therethrough, and a stop member slideably mounted in said channel opening having a portion thereof moveable into and out of stop contact abutment position in the path of sliding movement of said box means; said stop member extends downwardly sufficiently far to present a bottom end engageable by a supporting surface the dispenser is placed on and be pushed by the supporting surface as the dispenser is lowered to the supporting surface sufficiently to raise said stop member from the box means non stop position into the stop contact abutment position in the path of sliding movement of said box means.

6. The dispenser for elongate slender articles of claim 5, wherein said stop member is in the form of a "T" with the bottom stem of the "T" slideably mounted in said channel opening; and with opposite side arms of the "T" top extended outwardly to opposite sides sufficiently far to be moveable into and out of the path of movement of said box means opposite end wall downward extensions.

7. The dispenser for elongate slender articles of claim 5, wherein said stop member is in the form of a magnetic metal strap section slideably mounted in said channel opening; magnetic means imbedded in said mounting boss to hold said strap section in set position therein; and the stop member portion moveable into and out of stop contact abutment position in the path of sliding movement of said box means is a top end of said strap section moveable into position extending above the plane or the upper surface of said elevated base.

8. The dispenser for elongate slender articles of claim 5, wherein said stop member is in the form of an elongate plunger that is a position friction holding fit in said channel opening; and the stop member portion moveable into and out of stop contact abutment position in the path of sliding movement of said box means is a top end of said elongate plunger moveable into position extending above the plane of the upper surface of said elevated base.

9. A dispenser for elongate slender articles comprising: an elongate elevated base with spaced parallel side edges, and upper surface, a bottom, and opposite ends; a first support pedestal fastened to and extended downward from the bottom of said base; a second support pedestal fastened to and extended downward from the bottom of said base; elongate slender article storing box means having opposite side walls, opposite end walls, and a top, and with the walls presenting an open bottom; said box means opposite end walls having downward extensions grooved to encompass and slide along said side edges of said elongate elevated base with sliding movement of said box means back and forth over the upper surface of said elongate elevated base into and out of article dispensing position of said box means on said elongate elevated base; elongate slender article receiving and dispensing groove means in the upper surface of said elongate elevated base; opening means in said elongate elevated base in the path of said groove means to facilitate grasping a groove contained elongate article when said box means has been slid out of an article dispensing position on said elongate elevated base; and with said article dispensing groove means extended, other than for said opening means, transversely across said elongate elevated base from side edge to side edge thereof; wherein end limit position box means travel stop means is provided with said dispenser for limiting back and forth sliding movement of said box means on said elongate elevated base; said end limit position box means travel stop means at a first end of said elongate elevated base is stop contact abutment of ends of said box means opposite end walls downward extensions with said first support pedestal; with said first support pedestal sufficiently wide to present stop contact abutting surface in the path of said box means opposite end downward extensions; said second support pedestal is of sufficiently less width than said first support pedestal to permit sliding passage thereby of said box means for removal of the box means from said elongate base for refilling of said box means with elongate slender articles to be dispensed and replacement of the box means back on said elongate base; said end limit position box means travel stop means at a second end of said elongate elevated base is a box end travel position stop structure mounted at said second end of said elongate elevated base; said box end travel position stop structure, including a mounting boss with a channel opening extending therethrough, and a stop member slideably mounted in said channel opening having a portion thereof moveable into and out of stop contact abutment position in the path of sliding movement of said box means; said stop member extends downwardly sufficiently far to present a bottom end engageable by a supporting surface the dispenser is placed on and be pushed by the supporting surface as the dispenser is lowered to the supporting surface sufficiently to raise said stop member from the box means non stop position into the stop contact abutment position in the path of sliding movement of said box means.

10. The dispenser for elongate slender articles of claim 9, wherein said stop member is in the form of a "T" with the bottom stem of the "T" slideably mounted in said channel opening; and with opposite side arms of the "T" top extended outwardly to opposite sides sufficiently far to be moveable into and out of obstruction position to the path of movement of said box means opposite end wall downward extensions.

11. The dispenser for elongate slender articles of claim 9, wherein said stop member is in the form of a magnetic metal strap section slideably mounted in said channel opening; magnetic means imbedded in said mounting boss to hold said strap section in set position therein; and the stop member portion moveable into and out of stop contact abutment position in the path of sliding movement of said box means is a top end of said strap section moveable into position extending above the plane of the upper surface of said elevated base.

12. The dispenser for elongate slender articles of claim 9, wherein said stop member is in the form of an elongate plunger that is a position friction holding fit in said channel opening; and the stop member portion moveable into and out of stop contact abutment position in the path of sliding movement of said box means is a top end of said elongate plunger moveable into position extending above the plane of the upper surface of said elevated base.

* * * * *